US008212497B2

(12) United States Patent
Yadlapalli et al.

(10) Patent No.: US 8,212,497 B2
(45) **Date of Patent: *Jul. 3, 2012**

(54) BALLAST WITH LAMP-DIAGNOSTIC FILAMENT HEATING, AND METHOD THEREFOR

(75) Inventors: Naveen Yadlapalli, Billerica, MA (US); Uwe Liess, Treviso (IT)

(73) Assignee: Osram Sylvania Inc., Danvers, MA (US)

( * ) Notice: Subject to any disclaimer, the term of this patent is extended or adjusted under 35 U.S.C. 154(b) by 37 days.

This patent is subject to a terminal disclaimer.

(21) Appl. No.: 12/993,223

(22) PCT Filed: Jun. 23, 2009

(86) PCT No.: PCT/US2009/048247

§ 371 (c)(1),
(2), (4) Date: Nov. 17, 2010

(87) PCT Pub. No.: WO2009/158334

PCT Pub. Date: Dec. 30, 2009

(65) Prior Publication Data

US 2011/0062879 A1 Mar. 17, 2011

Related U.S. Application Data

(60) Provisional application No. 61/076,051, filed on Jun. 26, 2008.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 41/16* | (2006.01) |
| *H05B 41/24* | (2006.01) |

(52) U.S. Cl. ..... 315/294; 315/210; 315/226; 315/250; 315/307

(58) Field of Classification Search ..... None
See application file for complete search history.

(56) References Cited

U.S. PATENT DOCUMENTS 5,973,455 A * 10/1999 Mirskiy et al. ..... 315/105
(Continued)

FOREIGN PATENT DOCUMENTS

JP 11-162677 A 6/1999
(Continued)

OTHER PUBLICATIONS

Chang Gyun Kim, PCT International Search Report for PCT/US09/48247, Feb. 2, 2010, pp. 1-3, Korean Intellectual Property Office, Daejeon, Republic of Korea.

(Continued)

*Primary Examiner* — Douglas W Owens
*Assistant Examiner* — Dedei K Hammond
(74) *Attorney, Agent, or Firm* — Shaun P. Montana

(57) ABSTRACT

A ballast (10) for powering one or more gas discharge lamps (30,40) includes an inverter (100), an output circuit (200), a filament heating control circuit (300), and a control circuit (500). During a lamp filament detection period prior to startup of inverter (100), control circuit (500) monitors a signal within output circuit (200) in order to determine the number of lamps with intact filaments that are present at the ballast output connections (202, 204, . . . , 210, 212). During a lamp type detection period following startup of inverter (100), control circuit (500) monitors a current within filament heating control circuit (300) in order to determine the type of lamp(s) present at ballast output connections (202, 204, . . . , 210, 212). The determinations as to the number of lamps and the type of lamps are utilized by control circuit (500) to provide an appropriate level of heating to the lamp filaments. Preferably, control circuit (500) is realized by a microcontroller that is programmed with data relating to the different lamp types that may be powered by ballast (10).

21 Claims, 8 Drawing Sheets

U.S. PATENT DOCUMENTS

| | | | | |
|---|---|---|---|---|
| 7,183,714 | B1 | 2/2007 | Choudhury | |
| 2005/0067980 | A1* | 3/2005 | Krummel | 315/291 |

FOREIGN PATENT DOCUMENTS

| | | | |
|---|---|---|---|
| JP | 11-242998 | A | 9/1999 |
| JP | 2002-299089 | A | 10/2002 |
| JP | 2002-324689 | A | 11/2002 |
| JP | 2004-087328 | A | 3/2004 |
| JP | 2008-016393 | A | 1/2008 |
| WO | 2005-060320 | A1 | 6/2005 |

OTHER PUBLICATIONS

Chang Gyun Kim, PCT Written Opinion of the International Searching Authority for PCT/US09/48247, Feb. 2, 2010, pp. 1-4, Korean Intellectual Property Office, Daejeon, Republic of Korea.

* cited by examiner

BALLAST WITH LAMP-DIAGNOSTIC FILAMENT HEATING, AND METHOD THEREFOR

CROSS-REFERENCE TO RELATED APPLICATIONS

The present application claims priority of PCT International Application Serial No. PCT/US09/48247, filed Jun. 23, 2009, which claimed priority to U.S. Provisional Patent Application Ser. No. 61/076,051, filed Jun. 26, 2008, the entire contents of both of which are hereby incorporated by reference.

The present application is related to corresponding PCT International Application Serial No. PCT/US09/48236, filed Jun. 23, 2009 and entitled "Ballast with Lamp Filament Detection", which is owned by the same Assignee and has the same inventors as the present application, and which claimed priority to U.S. Provisional Patent Application Ser. No. 61/076,039, and which has entered the National Stage in the U.S. as U.S. application Ser. No. 12/993,220, filed on Nov. 17, 2010. The entire contents of all three of these related applications are hereby incorporated by reference.

TECHNICAL FIELD

The present invention relates to the general subject of circuits for powering gas discharge lamps. More particularly, the present invention relates to a ballast that provides filament heating in dependence upon the number and type of lamps that are connected to the ballast.

BACKGROUND

In an electronic ballast for powering gas discharge lamps, it is preferred that the ballast be capable of detecting the presence of functional lamps (i.e., lamps having both filaments intact and otherwise being in operational condition) at the ballast output connections. Such detection is useful, for example, in allowing the ballast to provide an appropriate level of heating to the filaments of the lamps, and may also be utilized to provide the ballast with enhanced capabilities for accurately detecting various types of lamp fault conditions and/or for accommodating relamping (wherein a failed lamp is replaced with a new lamp).

A number of existing programmed-start type ballasts utilize a direct current (DC) path through the lamp filaments to provide startup current to a driver circuit for the ballast inverter, thereby ensuring that the inverter will start only if at least one lamp with intact filaments is present at the output connections of the ballast. This approach works well in certain cases, but is often plagued by the problem of excessive power dissipation, especially in those applications for which the starting current requirements of the driver circuit are relatively high; in those cases, the DC path necessarily has a relatively low impedance (to allow higher current flow for meeting the starting current requirements of the driver circuit) which, during steady-state operation of the ballast, results in considerable power dissipation and thus significantly detracts from the overall energy efficiency of the ballast. Accordingly, a need exists for an alternative approach for detecting the presence of functional lamps (i.e., lamps with both filaments intact) that does not entail significant additional power dissipation within the ballast.

Ballasts with driven type inverters usually include some form of protection circuitry for protecting the ballast from excessive power dissipation and/or damage in the event of a lamp fault condition (e.g., removal or failure of one or more lamps). Such protection circuitry typically utilizes certain predetermined voltage thresholds in order to determine whether or not a lamp fault condition is present. In some ballasts, the protection circuitry is designed to accommodate relamping (i.e., replacement of a failed lamp with a new lamp) without requiring that the input power to the ballast be cycled (i.e., the power switch being turned off and then on again) in order to ignite and operate the new lamp. For ballasts that include protection circuitry, it would be helpful for the ballast to be able to ascertain, prior to lamp ignition, the presence of lamps with intact filaments connected at the ballast outputs, so as to establish appropriate voltage thresholds for determining whether or not a lamp fault condition is indeed present.

Therefore, a need exists for a ballast that is capable of detecting the presence of lamps with intact filaments in a reliable, cost-effective, and energy-efficient manner. Such a ballast would be capable of providing a number of benefits, including more appropriate levels of filament preheating as well as more accurate detection of lamp fault conditions, and would thus represent a considerable advance over the prior art.

In recent years, it has become desirable to provide a ballast that is capable not only of properly powering a varying number of lamps, but that is also capable of properly powering different types of lamps (e.g., T5, T5HO, T8, CFL and other lamps) without requiring any modifications to the ballast circuitry. The advantages and flexibility provided by such a ballast will be appreciated by those skilled in the art. Accordingly, a need exists for a ballast that is capable not only of determining the number of lamps with intact filament coupled to the ballast, but that is also capable of determining the lamp type of those lamps.

Different lamp types require different levels of filament heating. An appropriate level of filament heating is important to ensure proper ignition, operation, and life expectancy of the lamp(s). Accordingly, a need exists for a ballast that is capable of detecting the lamp type (e.g., T5, T5HO, T8, CFL and other lamps) of the lamp(s) that are connected to the ballast, and that uses that information, in combination with the detected number of operational lamps, to provide an appropriate level of heating to the filaments of the lamp(s). Such a ballast would represent a considerable advance over the prior art.

DETAILED DESCRIPTION

Figure 1:
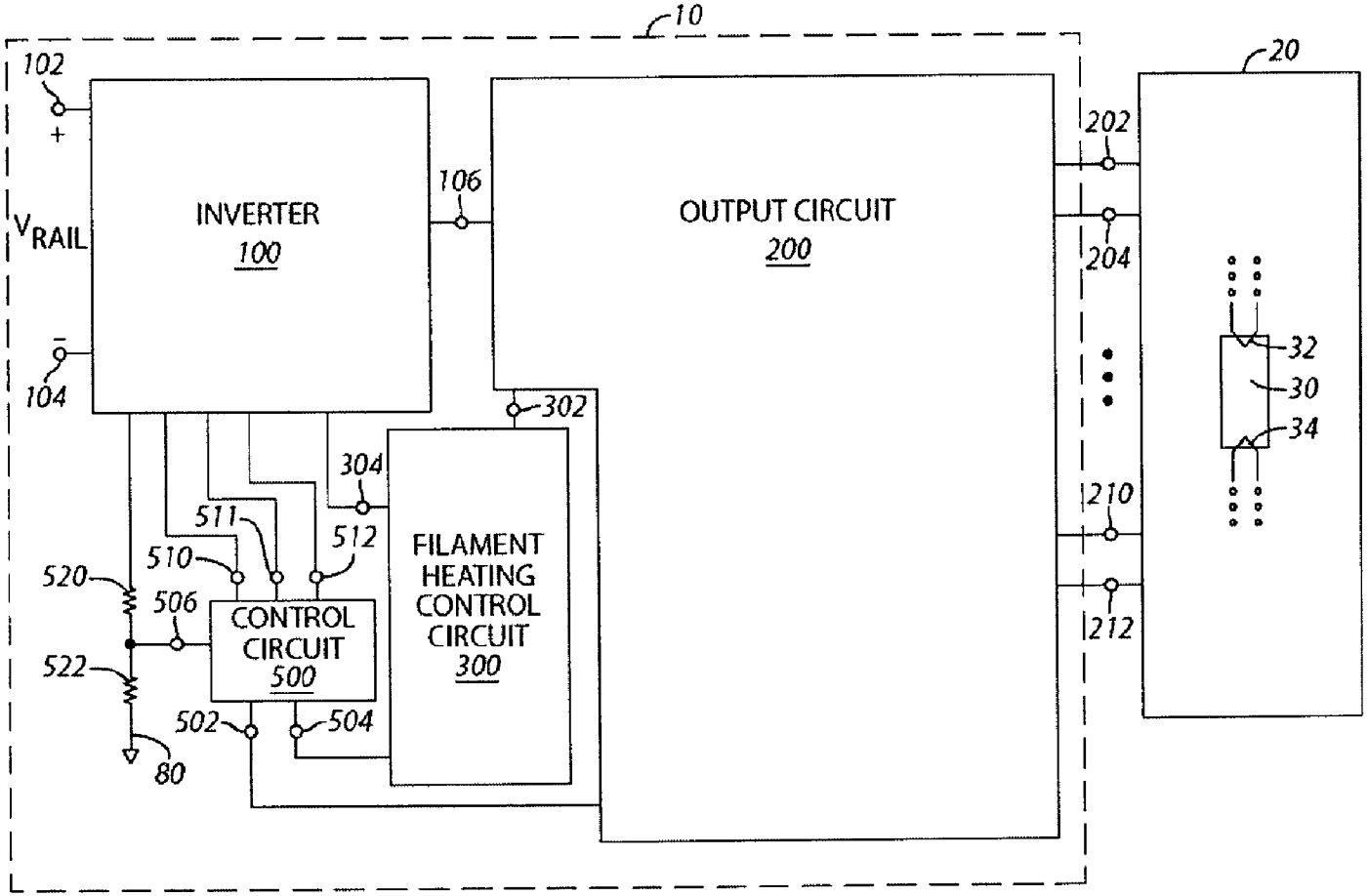
FIG. 1 is a partial block-diagram schematic of a ballast that includes circuitry for providing filament heating in dependence upon the number of lamps and the type of lamps connected to ballast, in accordance with a preferred embodiment of the present invention.

FIG. 1 describes a ballast 10 for powering a gas discharge lamp load 20. Lamp load 20 includes at least one gas discharge lamp 30 having a pair of lamp filaments 32,34. Ballast 10 comprises an inverter 100, an output circuit 200, a filament heating control circuit 300, and a control circuit 500.

Inverter 100 includes first and second input terminals 102, 104 and an inverter output terminal 106. First and second input terminals 102,104 are adapted to receive a source of substantially direct current (DC) voltage, $V_{RAIL}$, such as that which is commonly provided by a combination of a full-wave rectifier (powered from a conventional AC source—e.g., 277 volts at 60 hertz) and a DC-to-DC converter circuit (e.g., a boost converter). $V_{RAIL}$ is typically selected to have a steady-state operating magnitude that is on the order of several hundred volts; for example, for a commonly provided AC source voltage of 277 volts rms, $V_{RAIL}$ is typically selected to have a steady-state operating magnitude of about 450 volts. During operation, inverter 100 provides an alternating output voltage (typically selected to have a frequency in excess of 20,000 hertz) at inverter output terminal 106. The operational details of inverter 100 are known to those skilled in the art, and will not be discussed in detail herein. A preferred detailed structure for realizing inverter 100 is described herein with reference to FIGS. 2 and 3.

Output circuit 200 is coupled to inverter 100 and includes a plurality of output connections 202, 204, . . . , 210, 212 adapted for coupling to one or more lamps within lamp load 20. During operation, output circuit 200 receives the alternating output voltage at inverter output terminal 106 and provides a high voltage for igniting, and a magnitude-limited current for operating, the lamp(s) within lamp load 20. Additionally, output circuit 200 serves, in conjunction with filament heating control circuit 300, to provide appropriate levels of excitation for heating the filaments of the lamp(s) within lamp load 20. A preferred detailed structure for output circuit 200 is described herein with reference to FIGS. 2 and 3.

Filament heating control circuit 300 is coupled to output circuit 200 (via a first input 302), inverter 100 (via a second input 304), and control circuit 500 (via an input 504 of control circuit 500). During operation, in conjunction with inverter 100 and output circuit 200, filament heating control circuit 300 provides heating of the filaments of the lamp(s) within lamp load 20.

Control circuit 500 is coupled to inverter 100, output circuit 200, and filament heating control circuit 300. During operation, control circuit 500 serves three primary functions. First, during a lamp filament detection period prior to startup of inverter 100 (i.e., in the time between when power is applied to ballast 10 and when inverter 100 begins to operate), control circuit 500 determines the number of lamps with both filaments intact that are coupled to output circuit 200; that is, control circuit 500 detects whether or not one or two lamps with both lamp filaments intact are coupled to output connections 202, 204, . . . , 210, 212. Secondly, during a lamp type detection period following startup of inverter 100, control circuit 500, in conjunction with filament heating control circuit 300, determines the lamp type corresponding to the lamps within lamp load 20. Following the lamp type detection period, and based upon the aforementioned determinations as to the number and type of lamps, ballast 10 provides appropriate (i.e., lamp-diagnostic) heating of the filaments of the lamp(s) within lamp load 20. Third, the control circuit 500, along with the inverter 100 and output circuit 200 strikes and operates the lamps at their nominal ratings, depending on the detected lamptype.

With specific regard to the lamp filament detection function, ballast 10 and control circuit 500 operate, during the lamp filament detection period, to determine the number of lamps with intact filaments that are connected to ballast 10. More particularly, in an arrangement wherein two lamps are coupled to the output connections, control circuit 500 detects whether or not both of the lamps have both filaments intact; in an arrangement wherein only one lamp is coupled to the output connections, control circuit 500 detects whether or not the one lamp has both filaments intact. Thus, control circuit 500 operates to determine the presence of lamps with intact filaments that are connected to ballast 10. Preferably, and as described in further detail herein, this determination is ultimately utilized for the purpose of providing appropriate filament heating voltages to the lamp(s) that are connected to ballast 10 and for operating the lamps with their nominal current after ignition. However, it should be appreciated that the aforementioned determination may be used for other purposes (either alone or in combination with the preferred purpose of providing lamp-diagnostic filament heating), such as for setting/adjusting thresholds that are used for detecting lamp fault conditions and/or for accommodating relamping.

As described in FIG. 1, control circuit 500 preferably includes a filament detection input 502, a current-sensing input 504, and a plurality of control outputs 510, 511, 512. Filament detection input 502 is coupled to output circuit 200, current-sensing input 504 is coupled to filament heating control circuit 300, and control outputs 510, 511, 512 are coupled to inverter 100. During operation, and in the lamp filament detection period prior to startup of inverter 100, control circuit 500 receives, at filament detection input 502, a first voltage signal from output circuit 200 that indicates whether or not one or more lamps with intact lamp filaments are coupled to output connections 202, 204, . . . , 210, 212. Afterwards, in the lamp type detection period following startup of inverter 100 and during the preheating phase, control circuit 500 receives, at current-sensing input 504, a second voltage signal from filament heating control circuit 300 that indicates the lamp type of the lamp(s) with intact filaments that are coupled to output connections 202, 204, . . . , 210, 212. In a preferred application, as described in further detail herein, control circuit 500 utilizes the resulting control voltages to provide appropriate control signals at control outputs 510, 511, 512 to inverter 100 and filament heating control circuit 300 for ensuring that appropriate filament heating is provided to the filaments of the lamp(s) within lamp load 20.

As described in FIG. 1, filament heating control circuit 300 includes first and second inputs 302,304. First input 302 is coupled to output circuit 200, and second input 304 is coupled to inverter 100.

Figure 2:
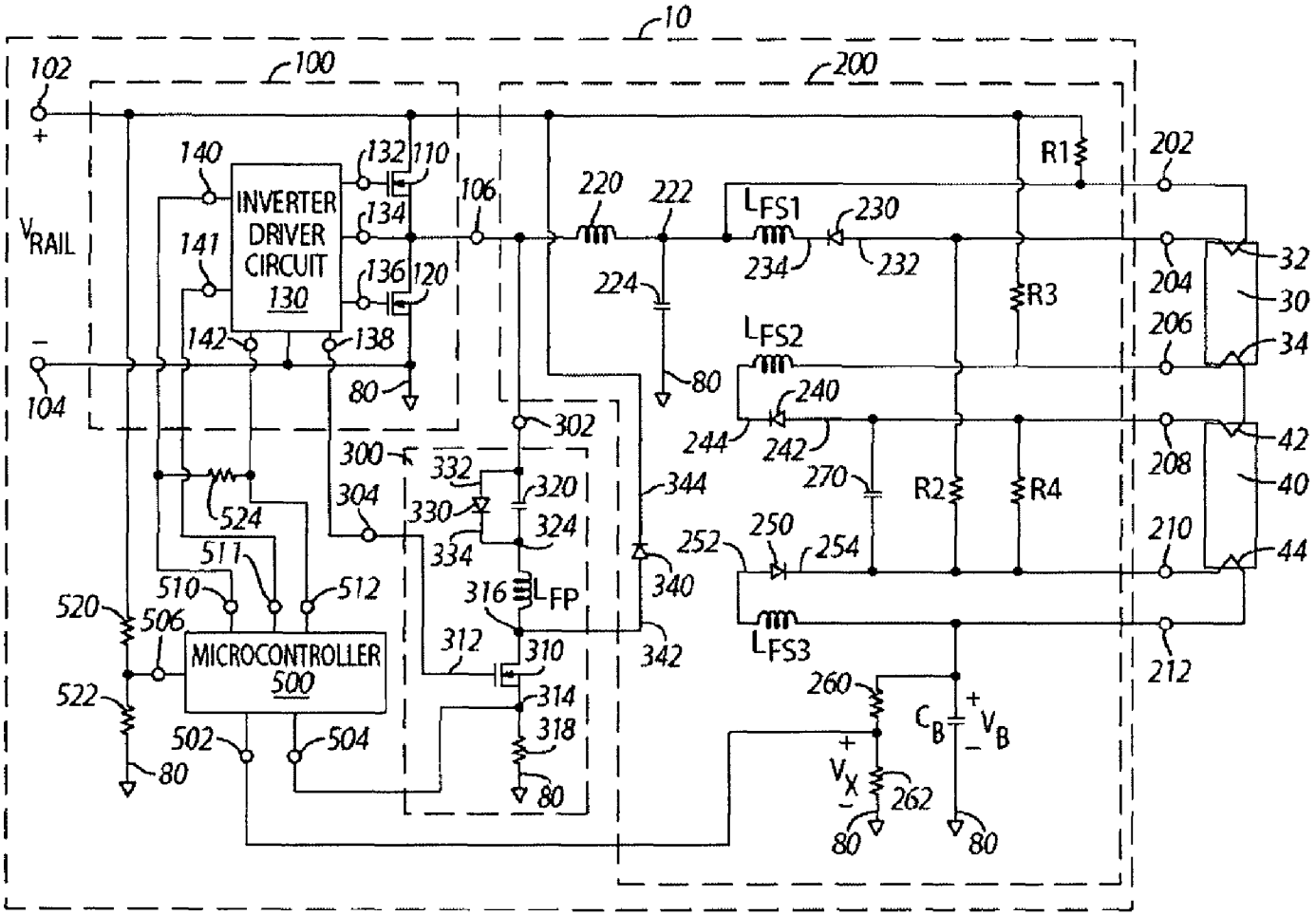
FIG. 2 is a circuit diagram of a ballast for powering two lamps, in accordance with a preferred embodiment of the present invention.
Figure 3:
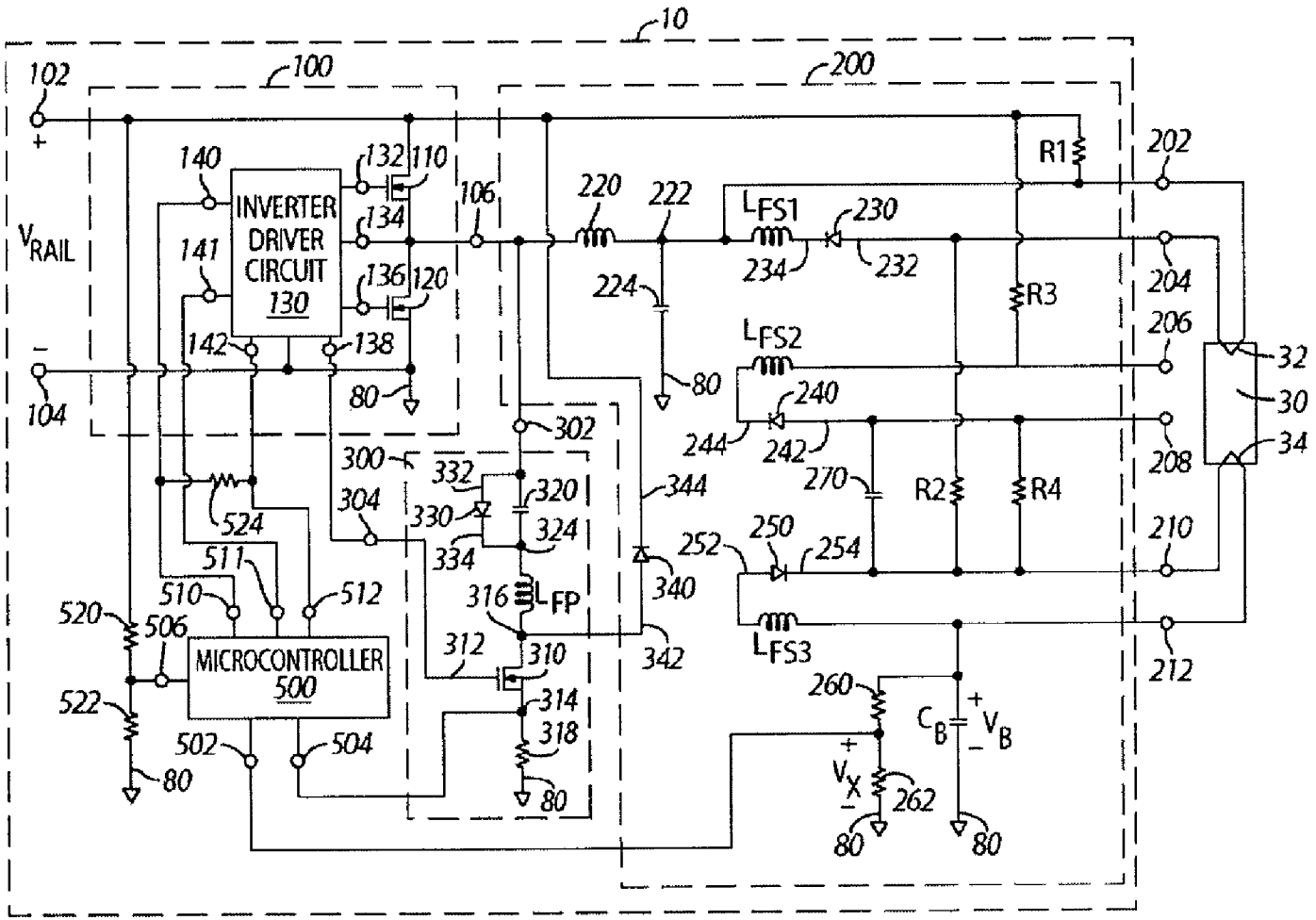
FIG. 3 is a circuit diagram of the ballast of FIG. 1, wherein the ballast is utilized to power only a single lamp, in accordance with a preferred embodiment of the present invention.

In a preferred embodiment of ballast 10, as described in FIGS. 2 and 3, control circuit 500 is realized by a suitable programmable microcontroller, such as the ST7LITE1B microcontroller integrated circuit manufactured by ST Microelectronics. In the following description, control circuit 500 is hereinafter referred to as microcontroller 500.

Preferably, microcontroller 500 is programmed with a look-up table that includes data for correlating the first and second voltage signals (which are monitored, respectively, during the lamp filament detection period and the lamp type detection period) with a desired parameter set for configuring the timing of the control signals to be provided by microcontroller 500 at outputs 510, 511, 512. The control voltages at outputs 510, 511, 512 are received by inverter 100. In response to the control signals, inverter 100 provides a suitable drive signal to input 304 of filament heating control circuit 300; the suitable drive signal dictates the level of filament heating that is ultimately provided to the filaments of the lamps within lamp load 20. In this way, ballast 10 provides an appropriate level of filament heating based upon the number and lamp type of the lamps within lamp load 20.

FIGS. 2 and 3 describe a preferred detailed structure for ballast 10 that is suitable for powering either two lamps (FIG. 2) or a single lamp (FIG. 3). It should be appreciated that microcontroller 500 is capable, provided that all filaments of the associated lamp(s) are intact, of distinguishing between the two-lamp arrangement of FIG. 2 and the one-lamp arrangement of FIG. 3. It should also be appreciated that the principles of the present invention are not limited to arrangements consisting of one or two lamps, but may be extended to arrangements that include three or more lamps. It should further be appreciated that microcontroller 500, operating in conjunction with filament heating control circuit 300, is capable, using information obtained during the lamp type detection period, of distinguishing between at least several different lamp types. Consequently, the preferred embodiment of ballast 10 may be used to power a lamp load consisting of either two lamps or a single lamp, wherein the lamp(s) are of one of several specified lamp types (e.g., T5, T5HO, T8, CFL etc.).

Referring to FIG. 2, inverter 100 is preferably realized as a driven half-bridge type inverter comprising first and second inverter switches 110,120 (preferably realized by N-channel field-effect transistors, as depicted in FIG. 2) and an inverter driver circuit 130. During operation, inverter driver 130 receives (at inputs 140,141) logic-level (i.e., low voltage) control signals from microcontroller 500 and, in response, commutates inverter switches 110,120 (via suitable drive signals provided at outputs 132, 134, 136) in a substantially complementary fashion (i.e., such that when transistor 110 is turned on, transistor 120 is turned off, and vice-versa) and at a high frequency rate that is typically selected to be greater than 20,000 hertz. Preferably, and as will be appreciated by those skilled in the art, the control signals provided at outputs 510,511 of microcontroller 500 (which control signals are received by inverter driver circuit 130 via inputs 140,141) dictate the timing of the commutation of FETs 110,120; inverter driver circuit 130 effectively amplifies and level shifts those control signals so as to provide appropriate drive signals for turning FETs 110,120 on and off in a desired and efficient manner.

During operation of inverter 100, the output voltage that is provided at inverter output terminal 106 is a substantially squarewave voltage that, taken with respect to circuit ground 80, periodically varies between the magnitude of $V_{RAIL}$ and zero. Inverter driver circuit 130 may be realized by any of a number of suitable devices known to those skilled in the art, such as the L6382D5 integrated circuit manufactured by ST Microelectronics. Alternatively, inverter driver circuit 130 may be realized by any of a number of discrete circuit arrangements that are known to those skilled in the art.

As described in FIG. 2, inverter driver circuit 130 preferably includes a plurality of inputs 140, 141, 142 and a plurality of outputs 132, 134, 136, 138. The signals at inputs 140, 141, 142 and at outputs 132, 134, 136, 138 are described as follows.

Input 140 of inverter driver circuit 130 is coupled to control output 510 of microcontroller 500; the signal at input 140 is used to control the commutation of inverter FET 110. More specifically, the logic-level (i.e., low voltage) signal provided at output 510 of microcontroller 500 is received at input 140 and is processed (i.e., amplified and/or level-shifted) by inverter driver circuit 130 so as to provide an output signal, between outputs 132,134, having a magnitude and power level that is sufficient for commutating FET 110 in a desired and reliable manner.

Along similar lines, input 141 of inverter driver circuit 130 is coupled to control output 511 of microcontroller 500; the signal at input 141 is used to control the commutation of inverter FET 120. More specifically, the logic-level (i.e., low voltage) signal provided at output 511 of microcontroller 500 is received at input 141 and is processed (i.e., amplified and/or level-shifted) by inverter driver circuit 130 so as to provide an output signal, between output 136 and circuit ground 80, having a magnitude and power level that is sufficient for commutating FET 120 in a desired and reliable manner.

Referring again to FIG. 2, input 142 of inverter driver circuit 130 is coupled to output 512 of microcontroller 500 and the output 510 of microcontroller 500 via resistor 524. More specifically, the logic-level (i.e., low voltage) signal provided at output 510 and 512 of micro-controller 500 is received at input 142 and is processed (i.e., amplified and/or level-shifted) by inverter driver circuit 130 so as to provide an output signal, between output 138 and circuit ground 80, having a magnitude and power level that is sufficient for commutating an electronic switch (e.g., FET 310) within filament heating control circuit 300 in a desired manner.

In the preferred low-cost arrangement described with reference to FIG. 2, wherein microcontroller 500 is preferably realized by a device such as the ST7LITE1B integrated circuit (manufactured by ST Microelectronics), a resistor 524 is coupled between control outputs 510,512 of microcontroller 500. Resistor 524 is utilized so that the signal (at output 512 of microcontroller 500) for controlling commutation of FET 310 (within filament heating control circuit 300) is substantially synchronized with the signal (provided at output 510 of micro-controller 500) for controlling commutation of inverter FET 110. In this preferred arrangement, output 512 of microcontroller 500 is configured as a so-called "open drain output" so as to allow for deactivation of filament heating control circuit 300 (i.e., keeping FET 310 turned off) in response to a digital signal.

As will be appreciated by those skilled in the art, the aforementioned preferred arrangement, wherein microcontroller 500 provides (at outputs 510, 511, 512) logic-level signals and inverter driver circuit 130 provides drive-level signals (i.e., signals, at outputs 132, 136, 138, having magnitudes and power levels that are sufficient for commutating power transistors in a desired manner), allows ballast 10 to be realized in a cost-effective manner. The preferred arrangement may be compared with an even more desirable alternative arrangement wherein the signal for commutating FET 310 is directly (as opposed to indirectly derived from control signal at output 510 of microcontroller 500) provided by microcontroller 500; such an alternative arrangement necessitates the incorporation of a more complex timer unit for generating the 3 control signals 510, 511, 512 (e.g., pulse-width modulation generators) within microcontroller 500, which is at the time of the invention not available in the market for a reasonable cost allowing for a low-cost solution.

Referring again to FIG. 2, output circuit 200 is preferably realized as a series-resonant type output circuit comprising first, second, third, fourth, fifth, and sixth output connections 202, 204, 206, 208, 210, 212, a resonant inductor 220, a resonant capacitor 224, a direct current (DC) blocking capacitor $C_B$, first and second voltage divider resistors 260,262, a plurality of resistances R1, R2, R3, R4, a capacitor 270, and filament heating circuitry (comprising secondary windings $L_{FS1}$, $L_{FS2}$, $L_{FS3}$ and diodes 230, 240, 250). First and second output connections 202,204 are adapted for coupling to a first filament 32 of a first lamp 30. Third and fourth output connections 206,208 are adapted for coupling to a second filament 34 of first lamp 30 and a first filament 42 of second lamp 40; as illustrated in FIG. 2, second filament 34 of first lamp 30 and first filament 42 of second lamp 40 are effectively connected in parallel with each other, so third and fourth output connections 206,208 are adapted for coupling to both filaments 34,42. Fifth and sixth output connections 210,212 are adapted for coupling to a second filament 44 of second lamp 40. Resonant inductor 220 is coupled between inverter output terminal 106 and a first node 222. Resonant capacitor 224 is coupled between first node 222 and circuit ground 80. DC blocking capacitor $C_B$ is coupled between sixth output connection 212 and circuit ground 80. First voltage divider resistor 260 is coupled between sixth output connection and voltage detection input 502 of microcontroller 500. Second voltage divider resistor 262 is coupled between voltage detection input 502 of microcontroller 500 and circuit ground 80. First resistance R1 is coupled between first input terminal 102 of inverter 100 and first output connection 202. Second resistance R2 is coupled between second output connection 204 and fifth output connection 210. Third resistance R3 is coupled between first input terminal 102 of inverter 100 and third output connection 206. Fourth resistance R4 and capacitor 270 are each coupled between fourth and fifth output connections 208,210.

Resistances R1, R2, R3, R4 (each of which may be realized by one or more resistors, as dictated by practical design considerations such as voltage and power ratings) collectively serve to allow microcontroller 500 to determine whether or not intact lamp filaments are connected to output connections 202, 204, 206, 208, 210, 212. More particularly, in a detection period that occurs prior to startup of inverter 100 (i.e., before inverter 100 begins to operate and provide commutation of inverter switches 110,120), resistances R1, R2, R3, R4 (in conjunction with filaments 32, 34, 42, 44 of lamps 30,40) provide filament current paths by which DC currents flow, provided that the associated lamp filaments are intact, into DC blocking capacitor $C_B$. In the two-lamp arrangement illustrated in FIG. 2, there are two distinct filament current paths; a first filament current path involves first filament 32 of first lamp 30 and second filament 44 of second lamp 40, and a second filament current path involves second filament 34 of first lamp 30, first filament 42 of second lamp 40, and second filament 44 of second lamp 40. In the one-lamp arrangement illustrated in FIG. 3, there is a single filament current path that involves first and second filaments 32,34 of lamp 30.

Resistances R1 and R2 together serve to provide the first filament current path that includes first filament 32 of first lamp 30 and second filament 44 of second lamp 40. That is, during operation of ballast 10 and in the period prior to startup of inverter 100, if filaments 32 and 44 are both intact, a first DC current flows from first inverter input terminal 102, through resistance R1, out of output connection 202, through filament 32, into output connection 204, through resistance R2, out of output connection 210, through filament 44, into output connection 212, through the parallel combination of capacitor $C_B$ and voltage divider resistors 260,262, and into circuit ground 80. The first DC current, taken by itself, contributes a voltage equal to $K_1*V_{RAIL}$ (where $K_1$ is a constant that is determined by the voltage divider formed by the resistances R1,R2 and resistors 260,262, the filament resistances within the current path are several magnitudes smaller than the other resistances and can therefore be neglected in calculating the constant $K_1$) to the voltage, $V_B$, that appears across DC blocking capacitor $C_B$ prior to startup of inverter 100.

Resistances R3 and R4 together serve to provide the second filament current path that includes second filament 34 of first lamp 30, first filament 42 of second lamp 40, and second filament 44 of second lamp 40. That is, during operation of ballast 10 and in the period prior to startup of inverter 100, if filaments 34, 42, and 44 are all intact, a second DC current flows from first inverter input terminal 102, through resistance R3, out of output connection 206, through filament 34, through filament 42, into output connection 208, through resistance R4, out of output connection 210, through filament 44, into output connection 212, through the parallel combination of capacitor $C_B$ and voltage divider resistors 260,262, and into circuit ground 80. The second DC current, taken by itself, contributes a voltage equal to $K_2*V_{RAIL}$ (where $K_2$ is a constant that is determined by the voltage divider formed by the resistances R3,R4 and resistors 260,262, and that is preferably chosen to be less than the constant $K_1$ associated with the first filament current path) to the voltage, $V_B$, that appears across DC blocking capacitor $C_B$ prior to startup of inverter 100.

It should be appreciated that both the first and second filament current paths include second filament 44 of lamp 40. This is desirable for safety purposes.

When both the first and second filament current paths are intact (i.e., when filaments 32, 34, 42, 44 are all intact), the voltage $V_B$ that appears across DC blocking capacitor $C_B$ prior to startup of inverter 100 is equal to $K_3*V_{RAIL}$ (where $K_3$ is a constant that is determined by the values of resistances R1, R2, R3, R4 and resistors 260,262). $K_3$ is therefore greater than constants $K_1$ and $K_2$ as one skilled in the art would understand.

In a preferred embodiment of ballast 10, as described in FIG. 2, filament heating control circuit 300 includes a capacitor 320, a diode 330, an electronic switch 310, a primary winding $L_{FP}$, and a current-sensing resistor 318. Capacitor 320 is coupled between first input 302 (which is coupled to inverter output terminal 106) and a first node 324. Diode 330 is coupled in parallel with capacitor 320, and has an anode 332 coupled to first input 302 and a cathode 334 coupled to first node 324. Electronic switch 310 is preferably realized an N-channel field-effect transistor (FET), and has a gate 312, a source 314, and a drain 316. Gate 312 of FET 310 is coupled to second input 304. Primary winding $L_{FP}$ is coupled between first node 324 and drain 316 of FET 310. Current-sensing resistor 318 is coupled between source 314 of FET 310 and circuit ground 80. Preferably, filament heating control circuit 300 also includes a voltage clamping diode 340 having an anode 342 coupled to drain 316 (of FET 310) and a cathode 344 coupled to input terminal 102 of inverter 100.

During operation, filament heating control circuit 300 provides two primary functions. First, during the lamp type detection period, filament heating control circuit 300, operating in conjunction with inverter 100 and output circuit 200 and being controlled by microcontroller 500, provides a nominal level of filament heating for the purpose of allowing microcontroller 500 to monitor the resulting current flow through primary winding $L_{FP}$, FET 310, and resistor 318; the voltage across resistor 318, which is proportional to that resulting current flow, is interpreted by microcontroller 500 to indicate the lamp type of the operational lamps coupled to the output of ballast 10. Secondly, after completion of the lamp type detection period, filament heating control circuit 300, again operating in conjunction with output circuit 200 and being controlled by microcontroller 500 through inverter driver circuit 130 (via second input 304), provides an appropriate level of filament heating that is optimized for the detected number and detected type of the lamps coupled to the output connections 202, 204, . . . , 210, 212 of ballast 10.

The filament heating circuitry within output circuit 200 comprises a plurality of filament heating circuits that include secondary windings $L_{FS1}$, $L_{FS2}$, $L_{FS3}$ and diodes 230, 240, 250. A first filament heating circuit, comprising a series combination of secondary winding $L_{FS1}$ and diode 230, is coupled between intermediate node 222 (which also connects to output 202) and second output connection 204; diode 230 has an anode 232 coupled to second output connection 204 and a cathode 234 coupled to $L_{FS1}$. A second filament heating circuit, comprising a series combination of secondary winding $L_{FS2}$ and diode 240, is coupled between third and fourth output connections 206,208; diode 240 has an anode 242 coupled to fourth output connection 208 and a cathode 244 coupled to $L_{FS2}$. A third filament heating circuit, comprising a series combination of secondary winding $L_{FS3}$ and diode 250, is coupled between fifth and sixth output connections 210,212; diode 250 has an anode 254 coupled to $L_{FS3}$ and a cathode 254 coupled to fifth output connection 210. Secondary windings $L_{FS1}$, $L_{FS2}$, $L_{FS3}$ are each magnetically coupled to a primary winding $L_{FP}$ within filament heating control circuit 300. During operation, secondary windings $L_{FS1}$, $L_{FS2}$, $L_{FS3}$ provide heating of lamp filaments 32, 34, 42, 44, and diodes 230, 240, 250 serve to effectively isolate $L_{FS1}$, $L_{FS2}$, $L_{FS3}$ from the filament current paths provided by resistances R1, R2, R3, R4. The level of filament heating provided by the three filament heating circuits to their corresponding lamp filament(s) is dictated by the operation of filament heating control circuit 300. More specifically, the voltages and currents which develop through secondary windings $L_{FS1}$, $L_{FS2}$, $L_{FS3}$, which voltages and currents are essentially provided to the respective lamp filaments, are controlled by the current/voltage through/across primary winding $L_{FP}$ within filament heating control circuit 300. The current/voltage through/across primary winding $L_{FP}$ is controlled by the duty cycle at which FET 310 is turned on and off. That duty cycle is controlled, in turn, by inverter driver circuit 130, based upon the control signal provided by microcontroller 500.

Voltage detection input 502 of microcontroller 500 is coupled to DC blocking capacitor $C_B$ via voltage divider resistors 260,262. More specifically, voltage detection input 502 is coupled to a junction of first voltage divider resistor 260 and second voltage divider resistor 262, and the series combination of first voltage divider resistor 260 and second voltage divider resistor 262 is coupled in parallel with capacitor $C_B$ (i.e., between sixth output connection 212 and circuit ground 80). It should be understood that the voltage $V_x$ across resistor 262 is simply a scaled-down version of the voltage $V_B$ across DC blocking capacitor $C_B$.

Microcontroller 500 preferably includes an input 506 for monitoring the DC rail voltage, $V_{RAIL}$. The provision of input 506 is useful in that it allows microcontroller 500 to effectively "track" the magnitude of $V_{RAIL}$; this capability is desirable because the filament detection function of microcontroller 500 is dependent upon the magnitude of $V_{RAIL}$, yet the magnitude of $V_{RAIL}$ is subject to some variation during operation (due to, for example, a brown-out condition or an overvoltage condition at the AC power source).

The detailed operation of ballast 10 is now described with reference to FIG. 2 as follows.

During the lamp filament detection period, when both lamps 30,40 are present with both filaments of each lamp being intact, both the first and second filament current paths are intact and thus both the first and second DC currents flow into the parallel circuit that includes DC blocking capacitor $C_B$ and voltage divider resistors 260,262. Consequently, the voltage $V_B$ (as defined and characterized above) across DC blocking capacitor $C_B$ will be at a first (i.e., relatively high) level. When only one lamp (with both filaments intact) is present, $V_B$ will be at a second (i.e., relatively low) level. Thus, the magnitude of $V_B$ prior to startup of the inverter is indicative of the number of functional lamps (i.e., lamps with intact filaments) that are connected to the output of ballast 10. Correspondingly, a scaled-down version of $V_B$—i.e., $V_X$—is conveyed to microcontroller 500 (via input 502). $V_x$ is interpreted by microcontroller 500 to determine whether or not lamps with intact filaments are present.

Figure 4A:
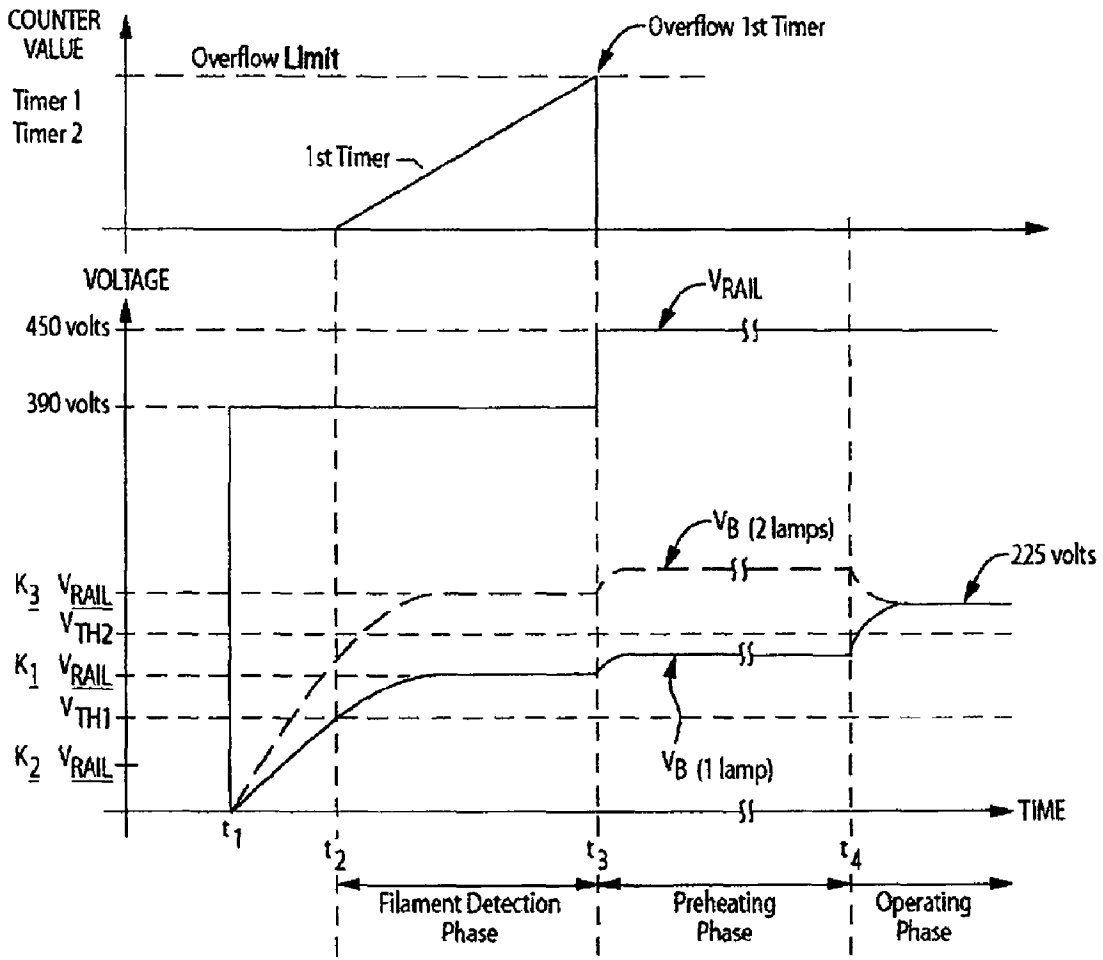
FIG. 4*a* describes a voltage across a DC blocking capacitor as a function of time in the arrangements depicted in FIGS. 2 and 3 for a single lamp, in accordance with a preferred embodiment of the present invention.
Figure 4B:
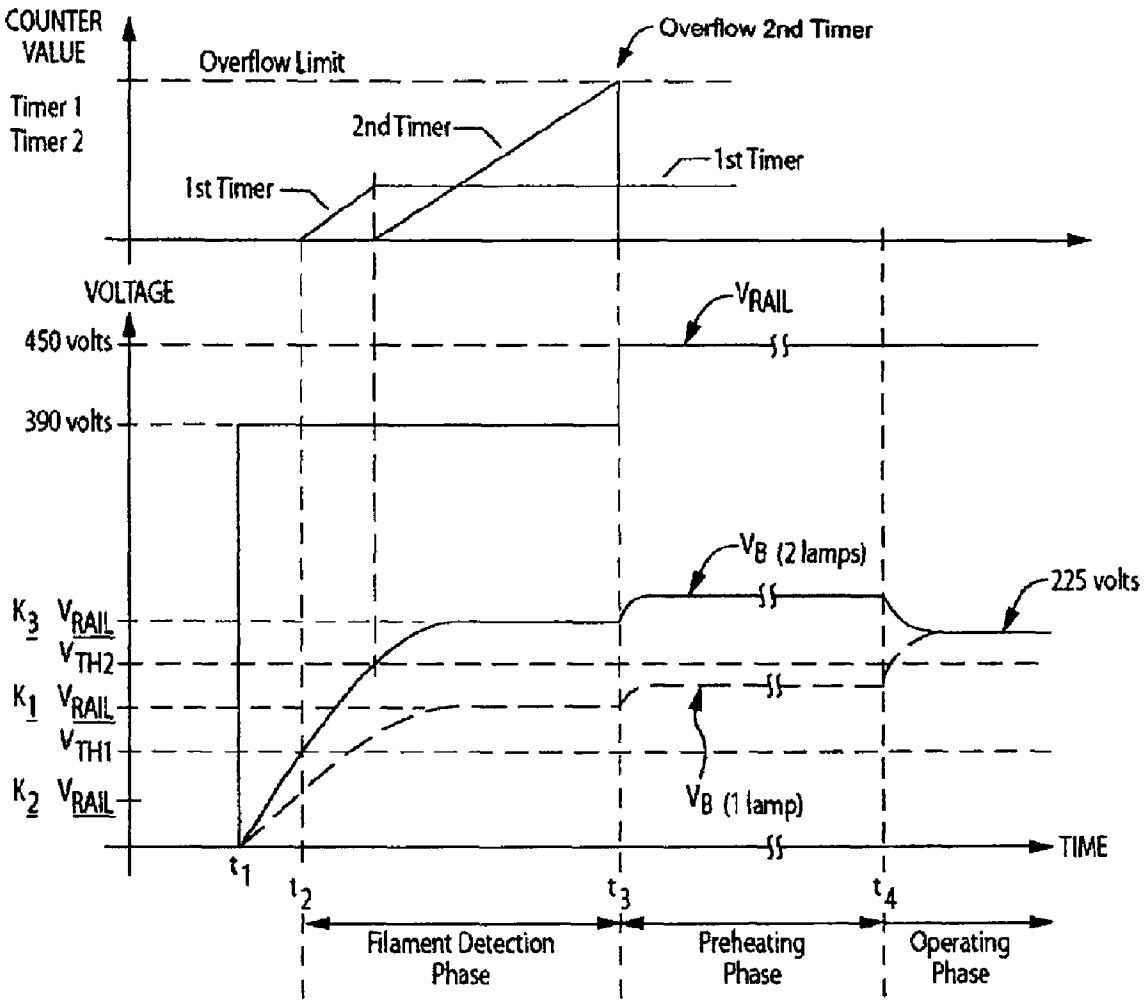
FIG. 4*b* describes a voltage across a DC blocking capacitor as a function of time in the arrangements depicted in FIGS. 2 and 3 for two lamps, in accordance with a preferred embodiment of the present invention.

A graphical description of the previously described functionality is provided in FIG. 4*a* for a single lamp operation and FIG. 4*b* for a two lamp operation, which illustrates approximate waveforms for $V_B$ and $V_{RAIL}$. $V_{TH1}$ and $V_{TH2}$ in FIG. 4*a* and FIG. 4*b* are to be understood as being proportional to $V_{X1}$ and $V_{X2}$, respectively.

Referring to FIG. 4*a*, AC power is initially applied to ballast 10 at time $t_1$. The DC rail voltage, $V_{RAIL}$, does not reach its steady-state operating value (e.g., about 450 volts) until time $t_3$. Prior to time $t_3$, $V_{RAIL}$ is at the peak of the AC line voltage (e.g., about 390 volts, for an AC power source voltage of 277 volts rms). Inverter 100 does not begin to operate until time $t_3$. Between time $t_1$ and time $t_3$, the voltage across DC blocking capacitor $C_B$ ramps up and eventually levels out. Until time $t_3$, which represents either first or second timer is reaching the predetermined overflow limit, microcontroller 500 begins to actively monitor $V_x$ (which, as previously explained, is simply a scaled-down version of $V_B$). At time $t_2$, $V_B$ is crossing $V_{TH1}$ and the first timer is starting to be increased periodically. At time $t_3$ (timer 1 overflow), which signifies the beginning of the preheat phase, the powerfactor correction circuit is turned on and $V_{RAIL}$ transitions to its steady-state operating value (e.g., 450 volts) and microcontroller 500 starts to apply control signals to inverter 100 and filament control circuit 300 to provide preheating of the lamp filaments. At time $t_4$, the preheating phase is completed and an ignition voltage is applied for starting the lamps. Once the lamps ignite, the voltage $V_B$ across DC blocking capacitor $C_B$ transitions to a steady-state operating value that is approximately equal to one half of $V_{RAIL}$ (e.g., about 225 volts, when $V_{RAIL}$ is set at 450 volts). Subsequently (i.e., in the "operating phase" which occurs after time $t_4$), ballast 10 supplies operating power to the lamps. Control signal 512 of micro controller 500 is set to zero in operation mode to turn off filament heating in the preferred low cost embodiment. However, other embodiments of the invention may use an independent PWM generator to control the dutycycle of the logic level signal on output 512 of microcontroller 500 independent of the dutycycle of logic level signal 510 of microcontroller 500, thus allowing change to the heating of heating circuit 300 during normal operation to any desired level.

In FIG. 4*b*, the trace that is labeled "$V_B$ (2 lamps)" depicts the voltage, $V_B$, across DC blocking capacitor $C_B$ in the two-lamp arrangement described in FIG. 2 under a condition wherein all of the filaments 32, 34, 42, 44 of lamps 30,40 are intact. The trace that is labeled "$V_B$ (1 lamp)" depicts the voltage, $V_B$, across DC blocking capacitor $C_B$ in the one-lamp arrangement described in FIG. 3 under a condition wherein both of the filaments 32,34 of lamp 30 are intact.

It should be appreciated that the trace labeled "$V_B$ (1 lamp)" in FIG. 4*a* is also representative of the voltage, $V_B$, across DC blocking capacitor $C_B$ that occurs in the two-lamp arrangement described in FIG. 2 under a condition wherein: (i) one or both of filaments 34,42 are not intact (i.e., the second filament current path, which includes R3 and R4, is open); and (ii) filaments 32,44 are both intact. This condition is typically treated as a lamp fault condition by associated protection circuitry within ballast 10, and is therefore of no consequence to the intended operation of microcontroller 500.

It should also be understood that there is a third possibility for $V_B$ that is not depicted in FIG. 4*a* or FIG. 4*b*. More particularly, in the two-lamp arrangement described in FIG. 2, and under a condition wherein filament 32 is open but the remaining filaments 34,42,44 are intact (i.e., the first filament path, including R1 and R2, is open, but the second filament path, including R3 and R4, is intact), $V_B$ will reach a magnitude that is less than $V_{TH1}$. Such a condition is essentially ignored by microcontroller 500, and is effectively treated as a condition wherein no lamps with both filaments intact are present (even though, in fact, both filaments 42, 44 of lamp 40 are intact).

Referring back to FIG. 2, during the lamp type detection period, which occurs after the lamp filament detection period and following startup of inverter 100, inverter driver circuit 130 provides (via output 138) a drive signal to second input 304 of filament heating control circuit 300 that effectuates switching of FET 310 at a nominal duty cycle. With FET 310 being commutated (i.e., turned on and off) at a nominal duty cycle, the resulting current flow through primary winding $L_{FP}$ is dependent upon the characteristics of the lamp filaments; that is, the magnitude of the resulting current flow is dependent, at least in part, upon the lamp type of the lamp(s) with intact filaments that are coupled to output connections 202, 204, 206, 208, 210, 212. For example, T8 type lamps will cause the resulting current to assume a peak value that is within a first range, while T5 type lamps will cause the resulting current to assume a peak value that is within a second range. During this period, the voltage across resistor 318 (which voltage is proportional to the current through primary winding $L_{FP}$; as previously noted, the current through primary winding $L_{FP}$ is indicative of the lamp type) is monitored by microcontroller 500 via current-sensing input 504. Microcontroller 500 consults a look-up table (which is programmed within microcontroller 500) that correlates the voltage at current-sensing input 504, as well as the previously determined number of lamps with intact filaments (or, equivalently, the value of $V_X$ during the lamp filament detection period), to adjust the timing to a corresponding desired value for the control signals to be provided at control outputs 510, 511 and 512. Depending on the number of different lamp types supported by the ballast, this procedure is repeated several times within a predefined time interval until the connected lamptype is identified with high reliability. Thus, upon completion of the lamp type detection period, microcontroller 500 sets the control signals (at outputs 510, 511, 512) for the rest of the preheating phase to a timing (frequency and/or duty cycle) that is indicative of the detected lamp type (in view of the detected number of lamps with intact filaments, which was previously determined during the lamp filament detection period) and selects a parameter set for the operation mode with appropriate values for the detected lamp type. Moreover, the total duration of the preheating phase may be varied to a timing that is indicative of the detected lamp type. In one example, a T5HO lamp may be preheated for 500 ms based on the detected lamp type. In another example, a different lamp may be preheated for 700 ms based on the different detected lamp type.

As described in FIG. 2, preferably, the resulting control signals (from outputs 510, 511 and 512 of microcontroller 500) are received by inverter driver circuit 130 (via inputs 140, 141 and 142) and are used to provide appropriate drive signals (via outputs 132, 134, 136 and 138) to inverter FETs 110 and 120 and to filament heating control circuit 300. The appropriate drive signal effectuates commutation of FET 310 at a duty cycle that results in an appropriate current flow through $L_{FP}$. The appropriate current flow through $L_{FP}$ induces appropriate currents through secondary windings $L_{FS1}$, $L_{FS2}$, $L_{FS3}$ which correspondingly, provide appropriate levels of filament heating to the filaments of the lamps. In this way, ballast 10 provides appropriate filament heating based upon the detected number and type of lamps.

FIG. 3 describes an alternative application in which ballast 10 is utilized to power a single lamp 30. First and second output connections 202, 204 are adapted for coupling to a first filament 32 of lamp 30. Fifth and sixth output connections 210,212 are adapted for coupling to a second filament 34 of lamp 30. In the one-lamp arrangement of FIG. 3, third and fourth output connections 206,208 are not utilized, and there is only a single filament current path (which includes R1 and R2). Consequently, resistances R3 and R4 serve no meaningful function in the operation of ballast 10 in the one-lamp arrangement depicted in FIG. 3.

The operation of ballast 10 in the one-lamp arrangement of FIG. 3 during the lamp type detection period is substantially similar to that which was previously described with reference to the two-lamp arrangement of FIG. 2. The only notable difference lies in the fact that, in the one-lamp arrangement of FIG. 3, the filament heating circuit comprising $L_{FS2}$ and diode 240 serves no function, as the corresponding output connections 206,208 are not utilized (i.e., not coupled to the single lamp 30).

In this way, ballast 10 operates in arrangements including a single lamp or multiple lamps to detect the presence of lamps with intact filaments and the lamp type of the lamps. As previously described, this detection is advantageously employed to provide appropriate levels of filament heating in arrangements that include different numbers of lamps and different lamp types.

Figure 5:
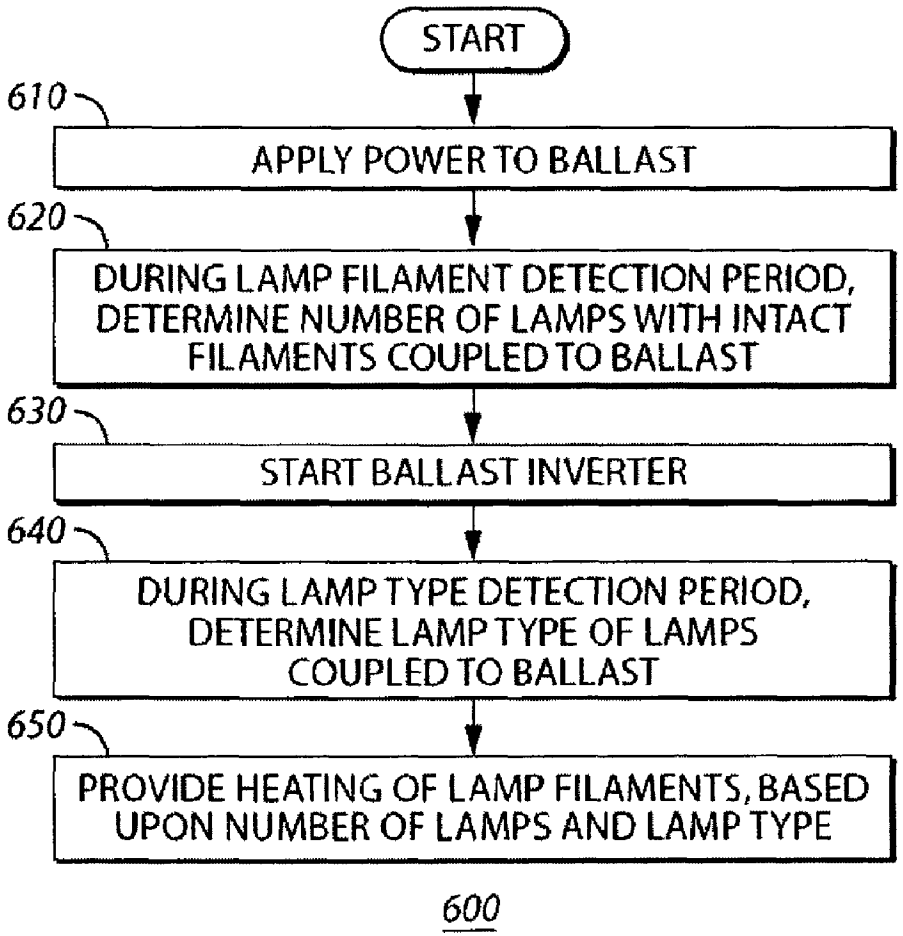
FIG. 5 describes a method for providing a ballast with lamp-adaptive filament heating, in accordance with a preferred embodiment of the present invention.
Figure 6:
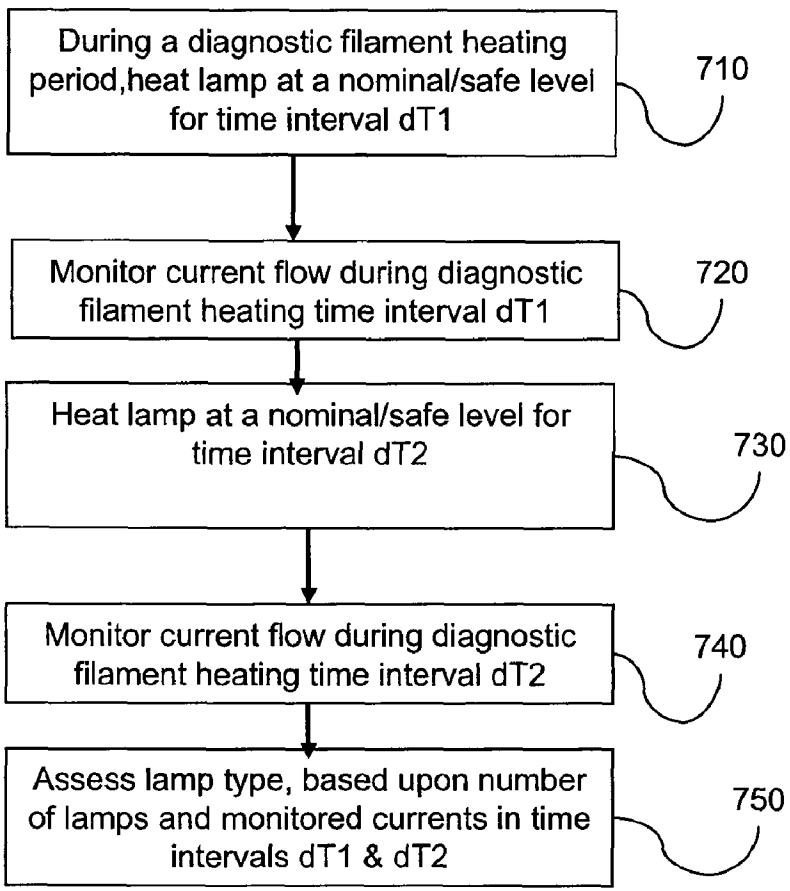
FIG. 6 describes an implementation of a method assessing lamp type in accordance with a preferred embodiment of the present invention.

FIGS. 5 and 6 collectively describe a method 600 for providing lamp-diagnostic heating of the lamp filaments. Method 600 is essentially directed to the same functionality that has already been discussed in connection with a preferred realization of ballast 10, as described in FIGS. 2 and 3. It should be appreciated, however, that the steps embodied in method 600 may be realized by circuitry that is substantially different from that which is described in the preferred realization of ballast 10.

Referring to FIG. 5, a method 600 of operating a ballast includes the following steps: (1) in step 610, applying power to the ballast; (2) in step 620, during a lamp filament detection period (i.e., between times $t_2$ and $t_3$, as illustrated in FIG. 4*a* and FIG. 4*b*), determining a number of lamps with intact filaments coupled to the ballast; (3) in step 630, starting an inverter within the ballast; (4) in step 640, during a lamp type detection period, determining the lamp type (e.g., T5, T5HO, T8, CFL and other lamps) of the lamps with intact filaments coupled to the ballast; and (5) in step 650, providing heating of the lamp filaments in dependence upon both: (i) the determined number of lamps with intact filaments coupled to the ballast (as executed in step 620); and (ii) the determined lamp type (as executed in step 640).

Turning now to FIG. 6, method 700 shows a method of accurately detecting the lamp type. Step 710 shows that during a diagnostic filament heating period, the lamp filaments are heated at a nominal or safe level for a time interval dT1. In step 720, the current flow (e.g., the current flowing through primary winding $L_{FP}$ of filament heating control circuit 300) is monitored during the diagnostic filament heating time interval dT1. In step 730, the lamp filaments are heated at nominal or safe level for a time interval dT2. In one example, the lamp filaments may be heated at a heating level during time interval dT1 that is different than the heating level applied during time interval dT2. In another example, the lamp filaments may be heated at a heating level during time interval dT1 that is the same as the heating level applied during time interval dT2. In step 740, the current flow is monitored during the diagnostic filament heating time interval dT2. In step 750, the lamp type is assessed based upon the number of lamps and the monitored currents during the time intervals dT1 and dT2.

Step 750 may be conducted by consulting a look-up table that is programmed into microcontroller 500. That is, microcontroller 500 is programmed with a look-up table in which the number of lamps with intact filaments connected to the ballast and the measured currents during the diagnostic filament heating periods is correlated with specific lamp types (e.g., T5, T5HO, T8, CFL and other lamps), and appropriate levels of filament heating for each of the specific lamp types. Correspondingly, microcontroller 500 uses the data in the look-up table to provide an appropriate output signal (via outputs 510, 511 and 512) to inputs 140, 141, 142 of inverter driver circuit 130; in turn, inverter driver circuit 130 provides an appropriate signal (via auxiliary output 138) to input 304 of filament heating control circuit 300, so as to turn FET 310 on and off at a duty cycle that will result in providing an appropriate level of filament heating to the filaments of the lamp(s) coupled to ballast 10.

In one example and still referring to FIG. 6, at least two current measurements may be taken during method 700 to determine the lamp type. In one example, at least one current measurement may occur at step 720 and at least one current measurement may occur at step 740. These measurements may be used at step 750 to assess the lamp type. In particular, filament resistances of the associated lamps may vary depending on whether the lamp filaments are in a "cold" or "hot" state. These resistances may affect the current measurements obtained at step 720 and step 740. A lamp filament may be in a "cold" state when the lamp filament has been resting in a non-heated state or for a short period of time directly after the lamp filament begins to be heated. A lamp filament in a "cold" state may have a cold filament resistance. A lamp filament may be in a "hot" state when the lamp filament is being heated or had previously been heated for a period of time. A lamp filament in a "hot" state may have a hot filament resistance. In one example, the at least one current measurement that occurs during step 720 is measured at time closely after the lamp detection period begins. In one example, a lamp filament may be heated at a heating level during time interval dT1 and the current measurement may be made during time interval dT1. This current measurement may correspond to the cold filament resistance. The at least one current measurement that occurs during step 740 is measured at a time after the lamp filament has been heated for a period of time. In one example, the lamp filament may be heated during time interval dT2 at the same heating level as during time interval dT2 and the current measurement may be made during time interval dT2. This current measurement may correspond to the hot filament resistance. The hot filament resistance will be greater than the cold filament resistance. In one example, the difference between the hot filament resistance and the cold filament resistance may result in the current measured at step 720 being different from the current measured at step 740. The different current measurements obtained during step 720 and step 740 may then be used to detect the lamp type in the system.

Figure 7:
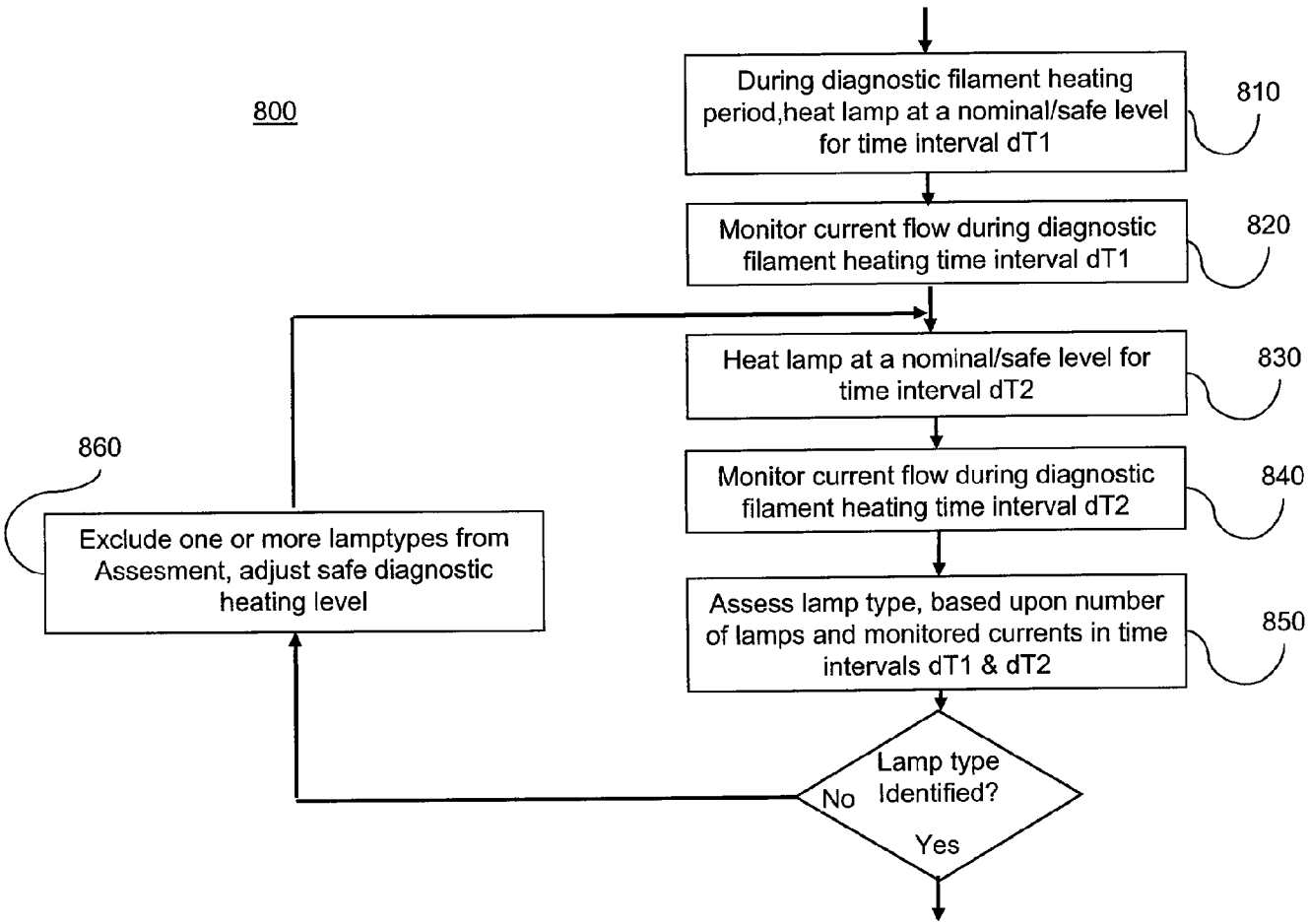
FIG. 7 describes an implementation of a method assessing lamp type in accordance with a preferred embodiment of the present invention.

Turning now to FIG. 7, method 800 shows another example method of accurately detecting multiple lamp types. Step 810 shows that during a diagnostic filament heating period, the lamp filaments are heated at a nominal or safe level for a time interval dT1. In step 820, the current flow (e.g., the current flowing through primary winding $L_{FP}$ of filament heating control circuit 300) is monitored during the diagnostic filament heating time interval dT1. In step 830, the lamp filaments are heated at nominal or safe level for a time interval dT2. In one example, the lamp filaments may be heated at a heating level during time interval dT1 that is different than the heating level applied during time interval dT2. In another example, the lamp filaments may be heated at a heating level during time interval dT1 that is the same as the heating level applied during time interval dT2. In step 840, the current flow is monitored during the diagnostic filament heating time interval dT2. In step 850, the lamp type is assessed based upon the number of lamps and the monitored currents during the time intervals dT1 and dT2.

Step 850 may be conducted by consulting a look-up table that is programmed into microcontroller 500. That is, microcontroller 500 is programmed with a look-up table in which the number of lamps with intact filaments connected to the ballast and the measured current during the diagnostic filament heating period is correlated with specific lamp types (e.g., T5, T5HO, T8, CFL and other lamps), and appropriate levels of filament heating for each of the specific lamp types. In some situations, however, certain lamp types are not able to be identified. If this is the case, then in step 860, certain lamp types may be excluded from assessment, the heating level may be changed and the diagnostic heating may be restarted and the method continued at step 830.

Although the present invention has been described with reference to certain preferred embodiments, numerous modifications and variations can be made by those skilled in the art without departing from the novel spirit and scope of this invention. For example, although the preferred embodiments described herein have specifically described arrangements involving two lamps and a single lamp, it should be appreciated that the principles of the present invention may be readily adapted for and/or applied to ballasts for powering three or more lamps. As another example, a separate driver circuit for FET 310 could be employed instead of sharing the one driver circuit for the three FETs denoted by reference numerals 110, 120, and 310. As another example a more sophisticated microcontroller 500 with additional more complex PWM modules could be used to control the duty cycle of inverter input 142 independent of inverter input 140 thus allowing for heating filaments of lamps 30 and 32 also during regular operation at any desired level rather than having only on/off capability for control during normal operation mode.

What is claimed is:

1. A ballast for powering a lamp load comprising at least one gas discharge lamp having a pair of lamp filaments, the ballast comprising:

an inverter;

an output circuit coupled to the inverter, the output circuit comprising a plurality of output connections adapted for coupling to the at least one gas discharge lamp;

a filament heating control circuit coupled to the inverter and to the output circuit, and operable to provide, in conjunction with the output circuit, heating of the filaments of the at least one lamp, wherein the filament heating control circuit includes first and second inputs;

a control circuit coupled to the output circuit, to the inverter, and to the filament heating control circuit, wherein the control circuit is operable:

(a) during a lamp filament detection period prior to startup of the inverter, to determine the number of lamps with both filaments intact that are coupled to the output circuit; and (b) during a lamp type detection period following startup of the inverter, to determine the lamp type corresponding to the lamps with both filaments intact, wherein the control circuit includes:

a filament detection input coupled to the output circuit;

a current-sensing input coupled to the filament heating control circuit; and at least one control output coupled to the inverter;

and wherein the control circuit is further operable:

(i) during the lamp filament detection period prior to startup of the inverter, to receive at the filament detection input a first voltage signal from the output circuit that is indicative of whether or not intact lamp filaments are coupled to the output connections;

(ii) during the lamp type detection period following startup of the inverter, to receive at the current-sensing input, a second voltage signal from the filament heating control circuit that is indicative of the lamp type of the lamps with intact filaments that are coupled to the output connections;

(iii) after completion of the lamp filament detection period and the lamp type detection period, to provide a control signal at the at least one control output in dependence upon the first and second voltage signals; and wherein the ballast is operable, following the lamp type detection period, to provide heating of the lamp filaments in dependence upon: (i) the determined number of lamps with both filaments intact; and (ii) the determined lamp type of the lamps with both filaments intact, and wherein the inverter includes an inverter driver circuit, comprising:

at least one input coupled to the at least one control output of the control circuit; and an output coupled to the second input of the filament heating control circuit;

and wherein the inverter driver circuit is operable to provide a filament heating control signal at the output in dependence upon the at least one control signal provided by the control circuit.

2. The ballast of claim 1, wherein the control circuit is realized by a microcontroller.

3. The ballast of claim 2, wherein the microcontroller is programmed with a look-up table, wherein the look-up table includes data for correlating the first and second voltage signals with a desired value for the control voltage.

4. The ballast of claim 1, wherein the filament heating control circuit further comprises:

a capacitor coupled between the first input and a first node;

a diode having an anode coupled to the first input and a cathode coupled to the first node;

an electronic switch (310) having a gate, a drain, and a source, wherein the gate is coupled to the second input;

a primary winding (LFP) coupled between the first node and the drain of the electronic switch; and a current-sensing resistor coupled between the source of the electronic switch and circuit ground.

5. The ballast of claim 4, wherein the electronic switch is an N-channel field-effect transistor.

6. The ballast of claim 4, wherein the output circuit comprises:

a plurality of output connections adapted for coupling to the at least one gas discharge lamp, the output connections including first, second, third, fourth, fifth, and sixth output connections;

a resonant inductor coupled between the inverter and an intermediate node;

a resonant capacitor coupled between the intermediate node and circuit ground;

a direct current (DC) blocking capacitor coupled between the sixth output connection and circuit ground; and a plurality of filament heating circuits, comprising:

a first filament heating circuit comprising a first series combination of a first secondary winding and a first diode, the first series combination being coupled between the intermediate node and the second output connection, wherein the first secondary winding is magnetically coupled to the primary winding within the filament heating control circuit;

a second filament heating circuit comprising a second series combination of a second secondary winding and a second diode, the second series combination being coupled between the third and fourth output connections, wherein the second secondary winding is magnetically coupled to the primary winding within the filament heating control circuit; and a third filament heating circuit comprising a third series combination of a third secondary winding and a third diode, the third series combination being coupled between the fifth and sixth output connections, wherein the third secondary winding is magnetically coupled to the primary winding within the filament heating control circuit.

7. The ballast of claim 6, wherein:

the first diode has an anode coupled to the second output connection and a cathode coupled to the first secondary winding;

the second diode has an anode coupled to the fourth output connection and a cathode coupled to the second secondary winding; and the third diode has an anode coupled to third secondary winding and cathode coupled to the fifth output connection.

8. The ballast of claim 6, wherein:

for an arrangement wherein the lamp load consists of two lamps:

the first and second output connections are coupled to a first filament of a first lamp;

the third and fourth output connections are coupled to a second filament of the first lamp and to a first filament of a second lamp; and the fifth and sixth output connections are coupled to a second filament of the second lamp; and for an arrangement wherein the lamp load consists of one lamp:

the first and second output connections are coupled to a first filament of the lamp; and the fifth and sixth output connections are coupled to a second filament of the lamp.

9. A ballast for powering a lamp load comprising at least one gas discharge lamp having a pair of lamp filaments, the ballast comprising:

an inverter, comprising:

first and second input terminals for receiving a source of substantially direct current (DC) voltage;

an output terminal;

first and second inverter switches coupled to the input terminals and to the output terminal; and an inverter driver circuit coupled to the first and second inverter switches, the inverter driver circuit including at least one input and a plurality of outputs, the plurality of outputs including a first output coupled to the first inverter switch, a second output coupled to the output terminal of the inverter, a third output coupled to the second inverter switch, and a fourth output;

an output circuit, comprising:

a plurality of output connections, comprising first, second, third, fourth, fifth, and sixth output connections;

a direct current (DC) blocking capacitor coupled between the sixth output connection and circuit ground;

a plurality of filament heating circuits, comprising:

a first filament heating circuit coupled between the first and second output connections;

a second filament heating circuit coupled between the third and fourth output connections; and a third filament heating circuit coupled between the fifth and sixth output connections;

a control circuit, comprising:

a filament detection input operably coupled to the DC blocking capacitor;

a current-sensing input; and at least one control output coupled to the at least one input of the inverter driver circuit;

a filament heating control circuit, comprising:

a first input coupled to the output terminal of the inverter; and a second input coupled to the fourth output of the inverter driver circuit; and wherein the current-sensing input of the control circuit is coupled to the filament heating control circuit.

10. The ballast of claim 9, wherein the control circuit includes a microcontroller.

11. The ballast of claim 9, wherein the filament heating control circuit further comprises:

a capacitor coupled between the first input and a first node;

a diode having an anode coupled to the first input and a cathode coupled to the first node;

an electronic switch (310) having a gate, a drain, and a source, wherein the gate is coupled to the second input;

a primary winding (LFP) coupled between the first node and the drain of the electronic switch; and a current-sensing resistor coupled between the source of the electronic switch and circuit ground.

12. The ballast of claim 11, wherein:

the first filament heating circuit comprises a first series combination of a first secondary winding and a first diode, the first series combination being coupled between the intermediate node and the second output connection, wherein the first secondary winding is magnetically coupled to the primary winding within the filament heating control circuit, and the first diode has an anode coupled to the second output connection and a cathode coupled to the first secondary winding;

the second filament heating circuit comprises a second series combination of a second secondary winding and a second diode, the second series combination being coupled between the third and fourth output connections, wherein the second secondary winding is magnetically coupled to the primary winding within the filament heating control circuit, and the second diode has an anode coupled to the fourth output connection and a cathode coupled to the second secondary winding; and the third filament heating circuit comprises a third series combination of a third secondary winding and a third diode, the third series combination being coupled between the fifth and sixth output connections, wherein the third secondary winding is magnetically coupled to the primary winding within the filament heating control circuit, and the third diode has an anode coupled to the fourth output connection and a cathode coupled to the second secondary winding.

13. The ballast of claim 12, wherein:

for an arrangement wherein the lamp load consists of two lamps:

the first and second output connections are coupled to a first filament of a first lamp;

the third and fourth output connections are coupled to a second filament of the first lamp and to a first filament of a second lamp; and the fifth and sixth output connections are coupled to a second filament of the second lamp; and for an arrangement wherein the lamp load consists of one lamp:

the first and second output connections are coupled to a first filament of the lamp; and the fifth and sixth output connections are coupled to a second filament of the lamp.

14. The ballast of claim 12, wherein the output circuit further comprises:

a resonant inductor coupled between the output terminal of the inverter and an intermediate node;

a resonant capacitor coupled between the intermediate node and circuit ground; and a plurality of resistances, comprising:

a first resistance coupled between the first input terminal of the inverter and the first output connection;

a second resistance coupled between the second and fifth output connections;

a third resistance coupled between the first input terminal of the inverter and the third output connection; and a fourth resistance coupled between the fourth and fifth output connections.

15. The ballast of claim 14, wherein the output circuit further comprises a series combination of a first voltage divider resistor and a second voltage divider resistor, the series combination being coupled in parallel with the DC blocking capacitor, wherein the filament detection input of the control circuit is coupled to a junction of the first voltage resistor and the second voltage divider resistor.

16. A method for operating a ballast for powering at least one gas discharge lamp having a pair of lamp filament, the method comprising the steps of:

applying power to the ballast;

determining, during a lamp filament detection period, a number of lamps with intact filaments coupled to the ballast;

starting an inverter within the ballast;

determining, during a lamp type detection period, the lamp type of the lamps with intact filaments coupled to the ballast; and providing heating of the lamp filaments in dependence upon: (i) the determined number of lamps with intact filaments coupled to the ballast; and (ii) the determined lamp type, wherein providing heating further includes varying the duration of a preheating phase of the lamp filaments in response to the determined lamp type.

17. The method of claim 16, wherein the step of determining the lamp type of the lamps connected to the ballast comprises the steps of:

during a diagnostic filament heating period, heating the lamp filaments at a nominal level;

monitoring a current flow during the diagnostic filament heating period; and assessing the lamp type based upon: (i) the current flow during the diagnostic filament heating period; and (ii) the determined number of lamps with intact filaments coupled to the ballast.

18. The method of claim 17, wherein the step of monitoring a current flow includes monitoring a current that flows through a primary winding of a filament heating transformer.

19. The method of claim 17, wherein the step of assessing the lamp type includes referring to a look-up table that is programmed into a microcontroller within the ballast.

20. The method of claim 16 wherein the determining step further comprises the steps of:

during a first diagnostic filament heating period, heating the lamp filaments at a first heating level and during a second diagnostic filament heating period, heating the lamp filaments at a second heating level;

measuring a current flow during the first diagnostic filament heating period and the second diagnostic filament heating period wherein the measuring of the current flow provides a first current measurement associated with the first diagnostic filament heating period and a second current measurement associated with the second diagnostic filament heating period; and assessing the lamp type based on the first current measurement and the second current measurement.

21. The method of claim 20 wherein the measuring step further includes measuring the current flow during the first diagnostic filament heating period wherein the first current measurement corresponds to a cold filament resistance and measuring the current flow during the second diagnostic heating period wherein the second current measurement corresponds to a hot filament resistance.

* * * * *